United States Patent [19]

Floyd

[11] 4,384,738

[45] May 24, 1983

[54] EXIT DEVICE WITH LOCK DOWN MECHANISM

[75] Inventor: Alfred E. Floyd, North Guilford, Conn.

[73] Assignee: Kidde, Inc., New Haven, Conn.

[21] Appl. No.: 197,520

[22] Filed: Oct. 16, 1980

[51] Int. Cl.[3] ..... E05C 15/02

[52] U.S. Cl. ..... 292/92; 292/336.3

[58] Field of Search ..... 292/21, 92, 144, 93, 292/201, 336.3

[56] References Cited

U.S. PATENT DOCUMENTS

| | | | |
|---|---|---|---|
| 816,792 | 4/1906 | Green et al. | 292/144 |
| 1,377,061 | 5/1921 | Deeg | 292/144 X |
| 2,466,481 | 4/1949 | Royal | 292/144 |
| 3,663,047 | 5/1972 | Zawadyki | 292/92 |
| 3,722,938 | 3/1973 | Bauer et al. | 292/92 |
| 3,877,262 | 4/1975 | Williams | 292/92 X |

*Primary Examiner*—Richard E. Moore

*Attorney, Agent, or Firm*—DeLio and Libert

[57] ABSTRACT

A lock-down mechanism for use with an exit door wherein an electromagnet on the door attracts an armature on the push rail when the latter is pushed to unlatch the door, the door being held unlatched as long as the electromagnet is energized.

2 Claims, 5 Drawing Figures

EXIT DEVICE WITH LOCK DOWN MECHANISM

This invention relates to a lock-down mechanism for use with the push rail, bar, or plate which actuates the latch of an exit door, as commonly provided in buildings such as schools, factories, and many types of public buildings.

When a door having its latch actuated by a push rail is likely to undergo periods of high activity, it is customary to provide "lock down" mechanisms which can be set, manually or otherwise, to hold the push rail in unlatched position during high traffic periods.

Devices dealing with this situation are shown in the U.S. Pat. Nos. to Zawadski, 3,663,047, and 3,767,238, as well as to Pappas, 4,006,471, and patents cited therein.

According to the present invention, a latch and actuator mechanism are mounted in one end of an elongated horizontally extended housing traversing a door. A push rail is supported on the housing for movement outwardly and inwardly relative thereto. Means are provided for operatively connecting the push rail to the actuator element to move the actuator element from its latch projected position to its latch retracted position in response to inward movement of the push rail. The operative connection means includes a bell crank mounted for pivotal movement about its apex adjacent the base of the housing, the pivotal axis of the bell crank extending generally transversely to the direction of motion of the latch bolt actuator element. The bell crank includes an arm acting as the latch bolt actuator element and an arm bearing slidably against the push rail.

The push rail is maintained in parallelism with the surface of the door by short parallel links pivotally connected to the door and to the push rail.

It is an object of the present invention to provide an electromagnet mounted in the push rail housing to hold the push rail in a "locked down" position when the magnet is energized.

It is a further object of the invention to provide the push rail with a free floating steel plate or armature which is lightly biased to a position where, during normal door operation, there is a gap between the steel plate and the electromagnet; when the magnet is energized and the push rail is moved to "unlatch" position, the steel plate jumps the gap and is held by the magnet until power is turned off.

It is another object of the invention to provide certain improvements in the form, construction, and arrangement of the several parts by which the above named and other objects may effectively be attained.

The invention accordingly comprises the features of construction, combinations of elements, and arrangement of parts which will be exemplified in the constructions hereinafter set forth, and the scope of the invention will be indicated in the claims.

A practical embodiment of the invention is shown in the accompanying drawing wherein.

Figures 1, 2, 3, 4, 5:
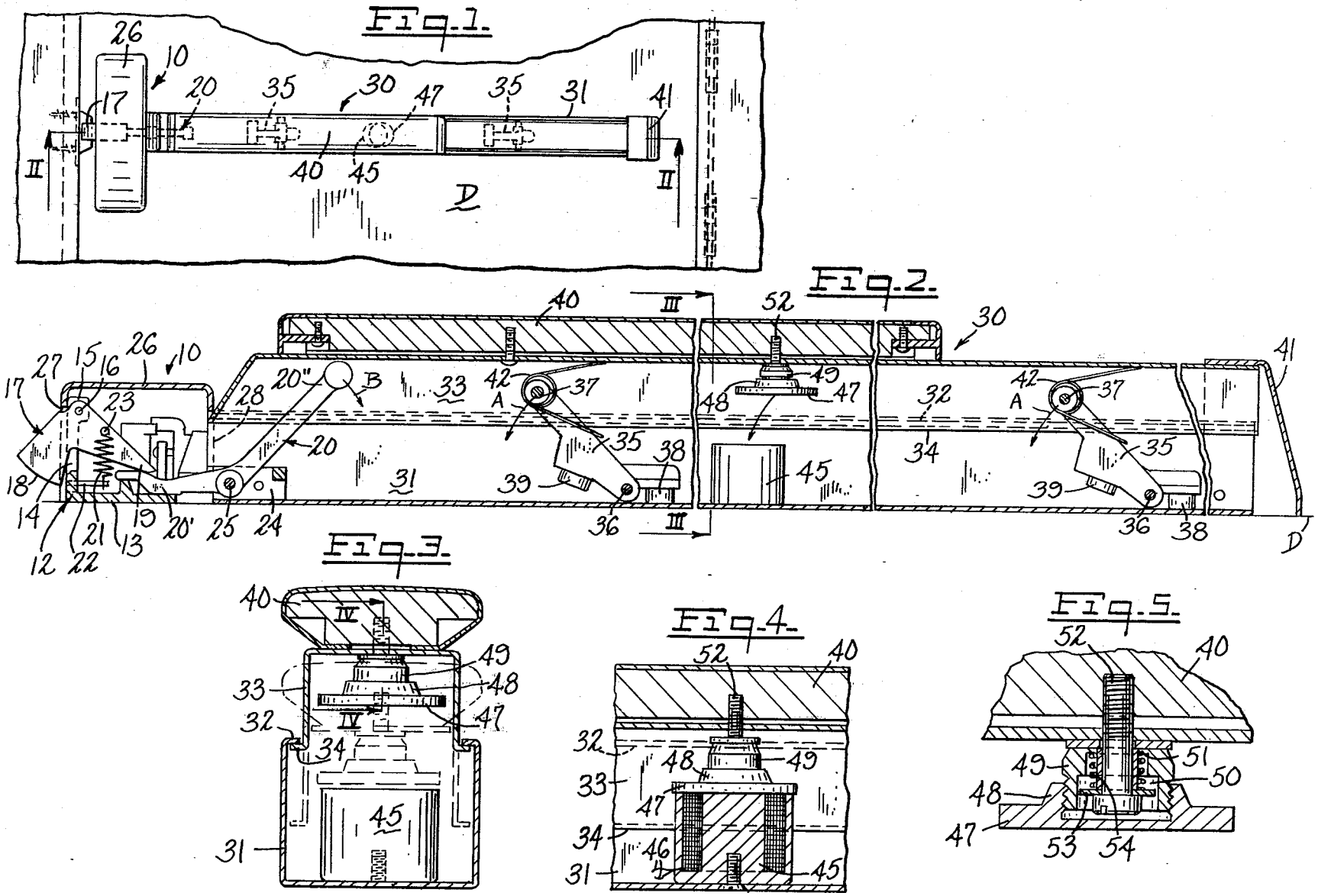
FIG. 1 represents a front elevation of a push rail latch actuating mechanism as mounted on a door, parts of which are broken away.
FIG. 2 represents a horizontal section on the line II—II of FIG. 1.
FIG. 3 represents a detail vertical section on the line III—III of FIG. 2, the "locked down" position of the push plate being shown in broken lines.
FIG. 4 represents a detail horizontal section on the line IV—IV of FIG. 3 showing the push plate in locked down position.
FIG. 5 represents a detail section, on an enlarged scale, showing the construction of the armature plate.

Referring to the drawings, the apparatus comprises a latch assembly 10 and a push rail assembly 30 adapted to be mounted in operative relationship on a door D. For purposes of illustration the latch is shown as being of the rim type but the mechanism can also be adapted for use on vertical rod or mortise lock type exit devices.

The latch assembly includes a chassis 12, the base 13 of which rests flat against the door surface, while spaced posts 14 extend at a right angle from the front edge of the base to a point 15 where they are enlarged to provide support for the latch pivot pin 16. The latch bolt 17 has a forward strike-engaging portion 18 and an integral tail portion 19 which extends rearwardly to a position where it can be engaged by the lift arm 20. The tail portion is biased toward latch-bolt extending position by a spring 21 between a pin 22 on the chassis and a pin 23 on one side of the tail portion. The base 13 has a rearward extension 24 in which the lift arm 20 is pivotally mounted on the pivot pin 25, one end 20' of the lift arm being beneath the tail portion 19 and the other end 20'' being angled outwardly to a position where it can be engaged by the inside of the push rail. The operative elements of the latch assembly are enclosed within a cover 26 which is provided with an aperture 27 for the latch bolt and a rear aperture 28 for connection with the push rail assembly 30.

The push rail assembly is shown as comprising the channel shaped mounting rail 31, the flat base of which is secured on the door surface in accurate alignment with the base 13 of the latch asssembly and in a position such that the extension 24 fits within one end of the rail 31. The push rail 33 is also channel shaped and is assembled with the mounting rail in inverted position, the free edges 34 of the push rail being bent outwardly to form flanges which underlie the inwardly bent edges 32 of the mounting rail, as shown in FIG. 3. Movement of the push rail relative to the mounting rail is controlled by the connecting arms 35, each of which is pivoted on the mounting rail by means of a pivot pin 36, journaled in opposite side walls of the push rail. Each connecting arm has a stop member 38 in a position to limit outward movement of the push rail and another stop member 39 in a position to limit inward movement of the push rail. When the push rail is in its outermost position (FIG. 2) the connecting arms extend at rather acute angles to the plane of the door surface, so that the movement of the push rail, when pushed, is in the direction of the arrows A, A in FIG. 2. At the same time, the end 20'' of the lift arm moves in the direction of the arrow B while its other end 20' lifts the tail portion 19 of the latch bolt to release the latch.

The push rail assembly also includes a touch bar 40, securely mounted on the outer wall of the push rail 33, and the magnetic lock down means to which this invention is particularly directed.

The rear end of the housing is closed by the end piece 41, the outer edge of which overlies the rear end of the push rail in its outermost (latched) position, shown in FIG. 2, and springs 42, carried by the outer end hub of each connecting arm 35, bias the connecting arms toward the push rail extended position.

The magnetic lock down means includes an electromagnet 45 to which current is supplied by wires 46 from a source, not shown, which may be more or less remotely located and an armature 47 in the form of a steel disc having a hollow threaded hub portion 48 into which is secured the ferrule 49 having a bore 50 one end of which is restricted by the annular flange 51. A bolt 52 has its head within the bore 50 which also contains a washer 53 resting against the underside of the bolt head and a light spring 54 between the washer 53 and the flange 51. The bolt 52 is screwed through the wall of the push rail and into the touch bar, the relative positions of the parts at rest, being as shown in FIGS. 2, 3, and 5.

The broken lines in FIG. 3 show that, when the push rail is depressed, the armature 47 is maintained by the spring 54 in a position out of contact with the electromagnet, thereby eliminating wear on the parts mentioned. However, when the electromagnet is energized and the push rail depressed, the armature readily jumps the gap to seat firmly on the magnet, as shown in FIG. 4, thus holding the push rail in its unlatched position as long as the magnet is supplied with current.

Locking down the push rail by remote control has the advantage that one switch can service a number of exit devices simultaneously.

In the case of fire exit doors, fire codes do not permit the use of mechanical "lock down" mechanisms which prevent doors from latching during a fire. An electromagnetic "lock down" system, remotely controlled, would overcome this problem when connected to an early warning alarm system which would allow the doors to close and latch during a fire.

It should be noted that the magnet does not draw down the push rail when energized—but sets the exit device so that the first user (initial depression of rail) automatically places it in the "locked down" position.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

What I claim is:

1. A latch and actuator mechanism for an exit door comprising, a housing mounted on a surface of the door, a latch bolt mounted on the door and movable between latched and unlatched positions, a push rail, means supporting said push rail for movement between first and second positions relative to the housing corresponding to the latched and unlatched positions of the latch bolt, means operatively connecting the push rail to the latch bolt, an electromagnet mounted in the housing, an armature carried by the push rail in a position to be attracted by the electromagnet when the push rail is in its second position, and means for optionally energizing the electromagnet, the armature being movable relative to the push rail, and the armature mounting including means biasing the armature toward a position wherein it cannot contact the electromagnet.

2. A mechanism according to claim 1 wherein the attraction of the electromagnet for the armature is greater than the oppositely directed force of said biasing means when the push rail is in its second position.

* * * * *